United States Patent [19]

Terzian et al.

[11] Patent Number: 4,802,878

[45] Date of Patent: Feb. 7, 1989

[54] DOLL WITH ROTATING AND BENDABLE ARMS

[75] Inventors: Rouben T. Terzian, Chicago; Walter J. Wozniak, Addison, both of Ill.

[73] Assignee: Marvin Glass & Associates, Chicago, Ill.

[21] Appl. No.: 11,903

[22] Filed: Feb. 6, 1987

[51] Int. Cl.[4] ..... A63H 3/28

[52] U.S. Cl. ..... 446/300; 446/303; 446/352; 446/379

[58] Field of Search ..... 446/196, 300, 303, 330, 446/331, 334, 335, 336, 338, 352, 353, 359, 361, 365, 379, 390, 391

[56] References Cited

U.S. PATENT DOCUMENTS

| | | | |
|---|---|---|---|
| 2,288,371 | 6/1942 | Rothschild | 446/354 |
| 3,147,566 | 9/1964 | Ong | 446/359 |
| 3,266,059 | 8/1966 | Stelle | 446/374 |
| 3,298,129 | 1/1967 | Katz | 446/300 |
| 3,731,427 | 5/1973 | Lewis et al. | 446/390 |
| 3,952,449 | 4/1976 | Terzian | 446/382 |
| 3,955,311 | 5/1976 | Lyons et al. | 446/335 |
| 4,186,517 | 2/1980 | Kuhn et al. | 446/390 |
| 4,571,208 | 2/1986 | Saigo et al. | 446/353 |

FOREIGN PATENT DOCUMENTS

| | | | |
|---|---|---|---|
| 1239603 | 4/1967 | Fed. Rep. of Germany | 446/196 |

*Primary Examiner*—Robert A. Hafer
*Assistant Examiner*—Charles H. Harris
*Attorney, Agent, or Firm*—John S. Pacocha

[57] ABSTRACT

A doll has bendable arms that are movable from a position generally alongside the doll's torso up toward the doll's head. Each arm has a hand attached for rotation about the wrist. When an arm is bent and moved up, the attached hand rotates. Movement of each arm is effected by a cable extending through a hollow, bendable conduit. One end of each cable is connected to a respective hand and at the other end to a common control knob. The hands are biased to rotate in one direction and rotate in the opposite direction when the respective cable is tightened. Side to side turning of the doll's head is also effected by movement of the control knob. In addition, a "crying" sound is effected through the control knob by turning over a sound drum when the arm and head motions are made.

13 Claims, 3 Drawing Sheets

88
94
92
106
104
102
88

138
134
136
130
132
23

25
30
120
116
114
21
128
130
23

114
124
122
138
116
148
138
142
117
80
82
84
106
76
152
150
78
104
72
148
142
117
144
116
114

25
30
120
122
124
138
130
132
134
23
116
114
126
128
21

DOLL WITH ROTATING AND BENDABLE ARMS

BACKGROUND OF THE INVENTION

1. Field of the Invention

This invention relates generally to dolls and more particularly to dolls having movable appendages.

2. Background Art

Dolls with movable appendages are old in the art but remain popular playthings. U.S. Pat. No. 3,724,125 discloses a doll with a spring loaded button control for moving separate limbs and a head connected to the button by cables. A doll whose arm can be pivoted at the shoulder and whose hand can be opened and closed by a cable connected to a lever on the doll body is disclosed in U.S. Pat. No. 3,713,252. Nevertheless, there remains a need for dolls with easily controlled movable appendages.

SUMMARY OF THE INVENTION

The present invention is concerned with providing a doll with bendable arms that are movable from a position generally alongside the doll's torso up toward the doll's head. Each arm has a hand attached for rotation about the wrist. When an arm is bent and moved up, the attached hand rotates. Movement of each of the arms is controlled by a cable extending through a hollow, bendable conduit. One end of each cable is connected to a respective hand and at the other end to a common control knob. The hand is biased to rotate in one direction and rotates in the opposite direction when the cable is tightened. Side to side turning of the doll's head is also effected by movement of the control knob. In addition, when the control knob is moved to make the arm and hand motions, a "crying" sound is created by turning a sound drum.

BRIEF DESCRIPTION OF THE DRAWINGS

For a better understanding of the present invention, reference may be had to the accompanying drawings in which.

DETAILED DESCRIPTION OF THE PREFERRED EMBODIMENT

Figure 1:
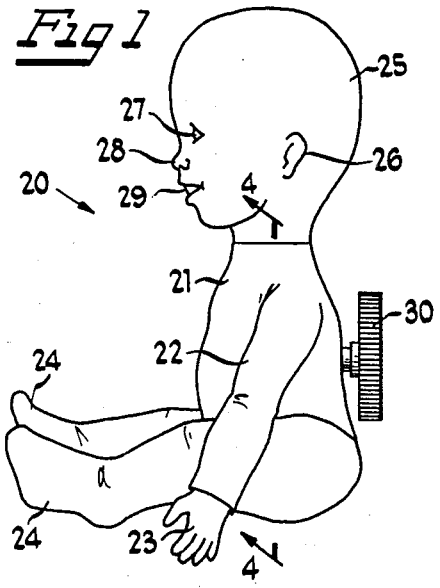
FIG. 1 is a side elevational view of an embodiment of the present invention showing an arm in a position generally down alongside the doll's torso and the head facing forward.

Referring now to the drawings in which like parts are designated by like reference numerals throughout the several views, FIG. 1 shows a doll 20 having a torso 21, arms 22 with hands 23 and legs 24. Atop torso 21 is a head 25 mounted for rotation with respect to the torso about an axis extending generally centrally through the length of the torso. Head 25 includes ears 26, eyes 27, a nose 28 and a mouth 29.

Extending out the back of torso 21 is a manually rotatable control knob 30. Torso 21 is made of relatively rigid plastic front and rear shells 32 and 34, respectively. Rotatable knob 30 is keyed on a square shaft 36 that is received for rotation in a bore 38 extending through back shell 34. A screw 40 secures knob 30 to shaft 36 against removal in an axial direction. Another screw 42 secures a gear 44 to the other end of square shaft 36 within torso 21 for rotation with shaft 36.

Figure 4:
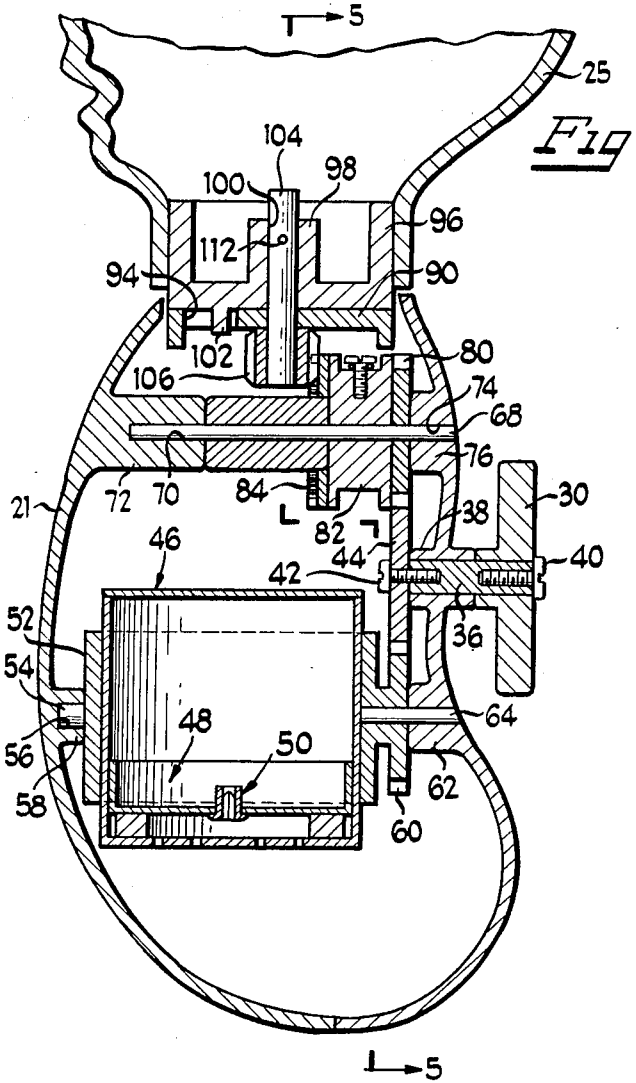
FIG. 4 is an enlarged scale, sectional view, taken generally along line 4—4 of FIG. 1.

Journaled within the lower part of torso 21 is a sound drum 46 which produces a "crying" sound when turned over. Inside of the drum is a weighted piston 48 carrying a reed assembly 50. Whenever drum 46 is rotated one hundred eighty degrees from the position shown in FIG. 4, piston 48 drops down with air passing through reed assembly 50.

Drum 46 is frictionally retained within ring 52 which has an integral stub shaft 54 on one side that is journaled in bore 56 of front shell boss 58. The side of ring 52 opposite stub shaft 54 has an integrally formed gear 60, the axis of which is concentric with that of stub shaft 54. Extending through aligned bores in ring 52, gear 60 and rear shell boss 62 is a shaft 64. Gear 60 engages gear 44 so that rotation of control knob 30 rotates sound drum 46 about the axes of stub shaft 54 and shaft 64.

Above gear 44, a shaft 68 is mounted in bore 70 of front shell boss 72 and bore 74 of rear shell boss 76. Fitted for rotation on shaft 68 is a gear assembly 78 including gear 80, sheave 82 and crown gear 84. All of gear assembly rotates together with gear 80 disposed above, and in engagement with, control knob driven gear 44.

Integrally formed with rear shell 34, disposed below the top wall on opposite sides of a semicircular cutout, are support ledges 86. Supported about the axis of laterally extending trunnions 88 received in ledges 86, is a disk 90. Extending axially through disk 90 is a bore 92. Adjacent the rear periphery of disk 90 is an arcuate slot 94. Disposed above disk 90 is a head mounting collar 96 having a central core 98 through which an axial bore 100 extends. Depending down from the lower face of collar 96 is a stud 102. A shaft 104 having a pinion gear 106 secured onto, or integrally formed with, its lower end extends up through aligned bores 92 and 100 of disk 90 and collar 96, respectively.

Shaft 104 has a transverse hole 108 adjacent its upper end which mates with a transverse hole 110 in boss 98 such that a pin 112 inserted through holes 108 and 110 keys collar 96 for rotation with shaft 104. Head 25 frictionally engages collar 96 so that as gear 44 drives gear 80, crown gear 84 engages pinion 106, which then rotates collar 96 and hence head 25 to one side or the other of torso 21. Stud 102 will abut an end of arcuate slot 94 to limit the sideward turning of head 25.

Each of arms 22 have a L-shaped shoulder piece 114 made of relatively rigid plastic. Shoulder piece 114 includes a pair of spaced apart flanges 116 and 117 defining an annular groove which receives the mating cutout edges 118 and 119 of torso shells 32 and 34 to mount arm 22 for rotation relative to the torso. Outer flange 116 is not complete but has an open gap of approximately ninety degrees. To the rear of cutout 119, shell 34 has a stop 120. A conduit 122 extends along the interior of shoulder piece 114 communicating with the hollow interior of torso 21 formed by shells 32 and 34.

Received in the outer end of conduit 122, in frictional engagement with shoulder piece 114, is a tube 124 made of flexible plastic and having a number of slits 126 along one side of the tube. Fitted around tube 124 is a piece of soft foam material 128. Secured onto the bottom of tube 124 is a slotted coupling 130. Coupling 130 does not rotate with respect to tube 124. The lower part of coupling 130 is received within the upwardly directed annular opening of cuff 132 for rotation relative to the cuff. A torsion spring 134 has each end anchored to each of coupling 130 and cuff 132. Connecting the coupling and the cuff together axially is a screw 136. Hand 23 is fitted around cuff 132 to rotate with the cuff.

Figures 6, 7, 8, 9, 10:
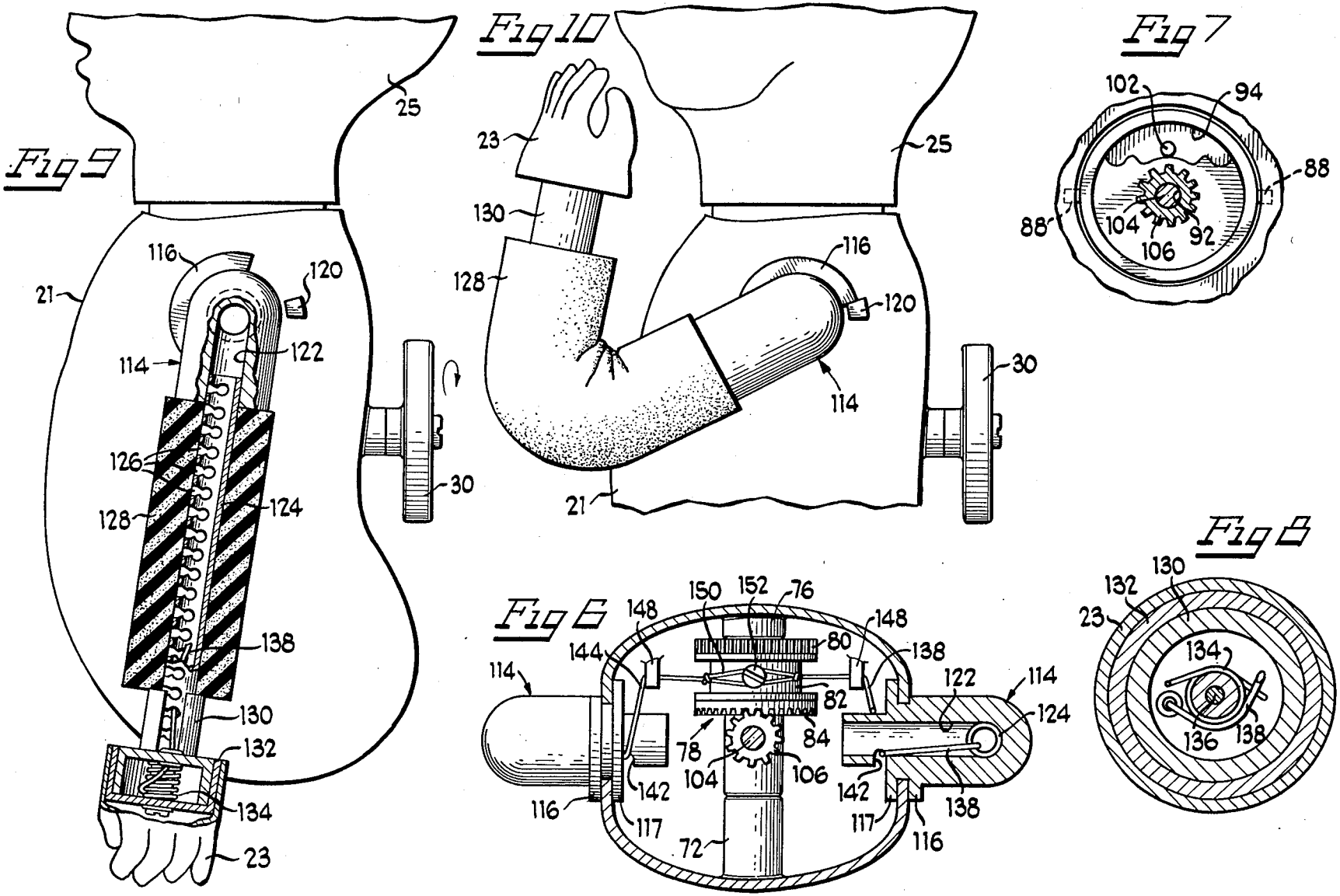
FIG. 6 is a sectional view taken generally along line 6—6 of FIG. 5.
FIG. 7 is a sectional view taken generally along line 7—7 of FIG. 5.
FIG. 8 is a sectional view taken generally along line 8—8 of FIG. 5.
FIG. 9 is an enlarged scale, side elevational view showing an arm in a position generally down alongside the doll's torso and the head facing forward as in FIG. 1 partially in section through the arm.
FIG. 10 is an enlarged scale, side elevational view showing an arm bent upwardly toward the head with the hand turned inwardly and the head turned outwardly as in FIG. 2.

One end of a cable 138 is secured to cuff 132. Cable 138 then passes through an aperture 140 in coupling 130 and then through one of the slits 126 into tube 124, as is best illustrated in FIG. 9. From tube 124, cable 138 passes through conduit 122 of shoulder 114, out through a bore 142, and into torso 21. Another cable 144, connected to a cuff mounting the left hand, passes through the left arm into torso 21 in a similar manner. Each cable passes through a respective eyelet 146 formed in an integral extension 148 of rear shell 34 adjacent the internal end of each shoulder piece 114. Both cables are connected to each other so as to form a small loop 150 through which a screw 152 passes to secure both lines to sheave 82.

Figure 2:
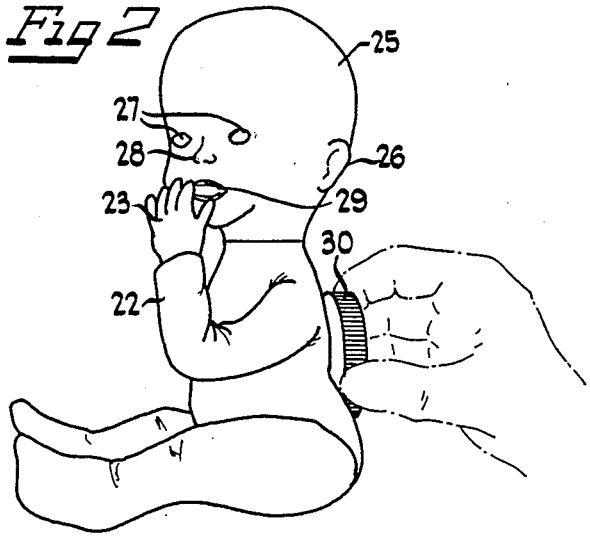
FIG. 2 is a side elevational view showing the arm bent upwardly toward the doll's head with the hand turned inwardly and the head turned outwardly.
Figure 3:
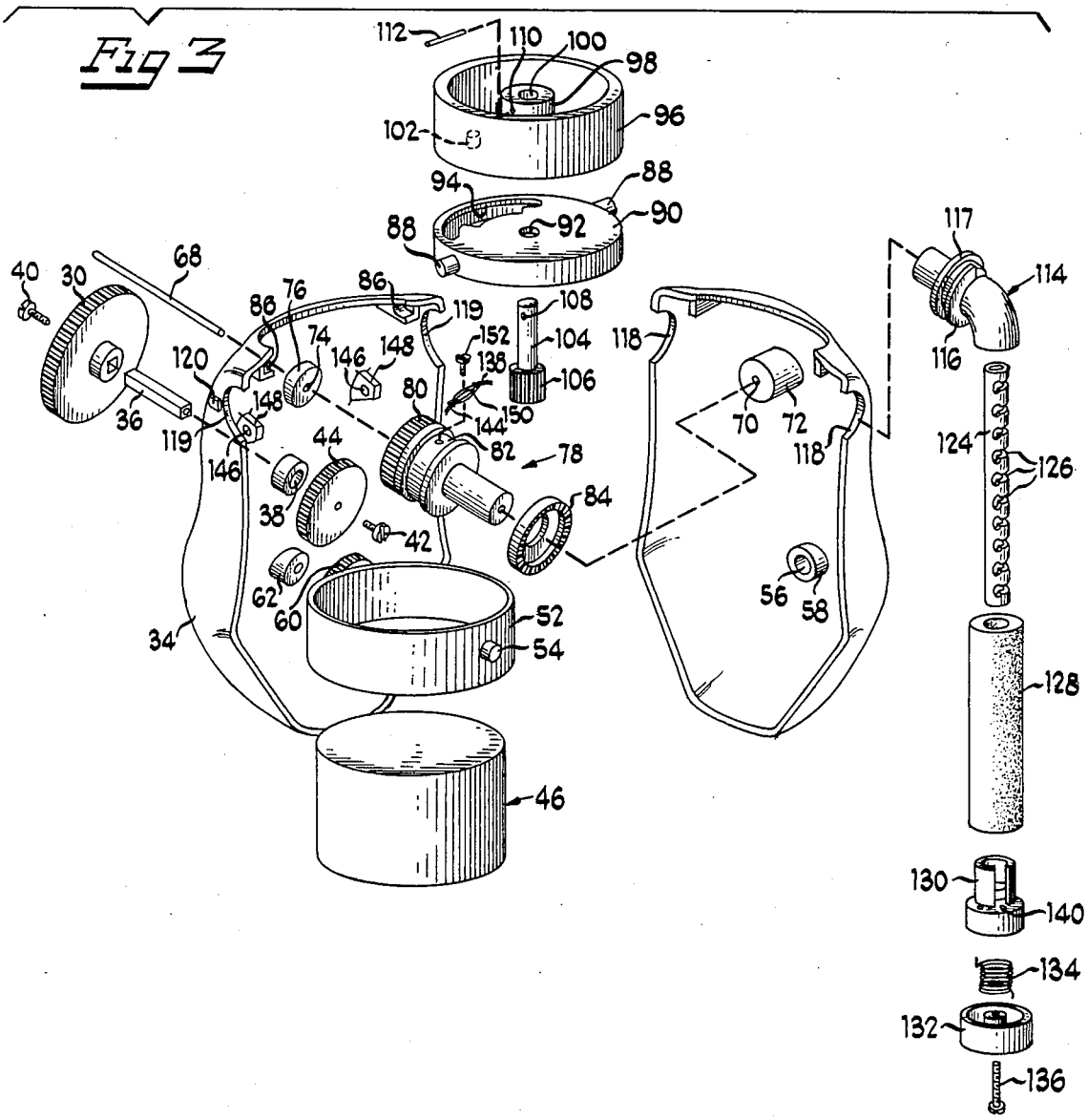
FIG. 3 is an enlarged scale, exploded perspective view of some of the components.
Figure 5:
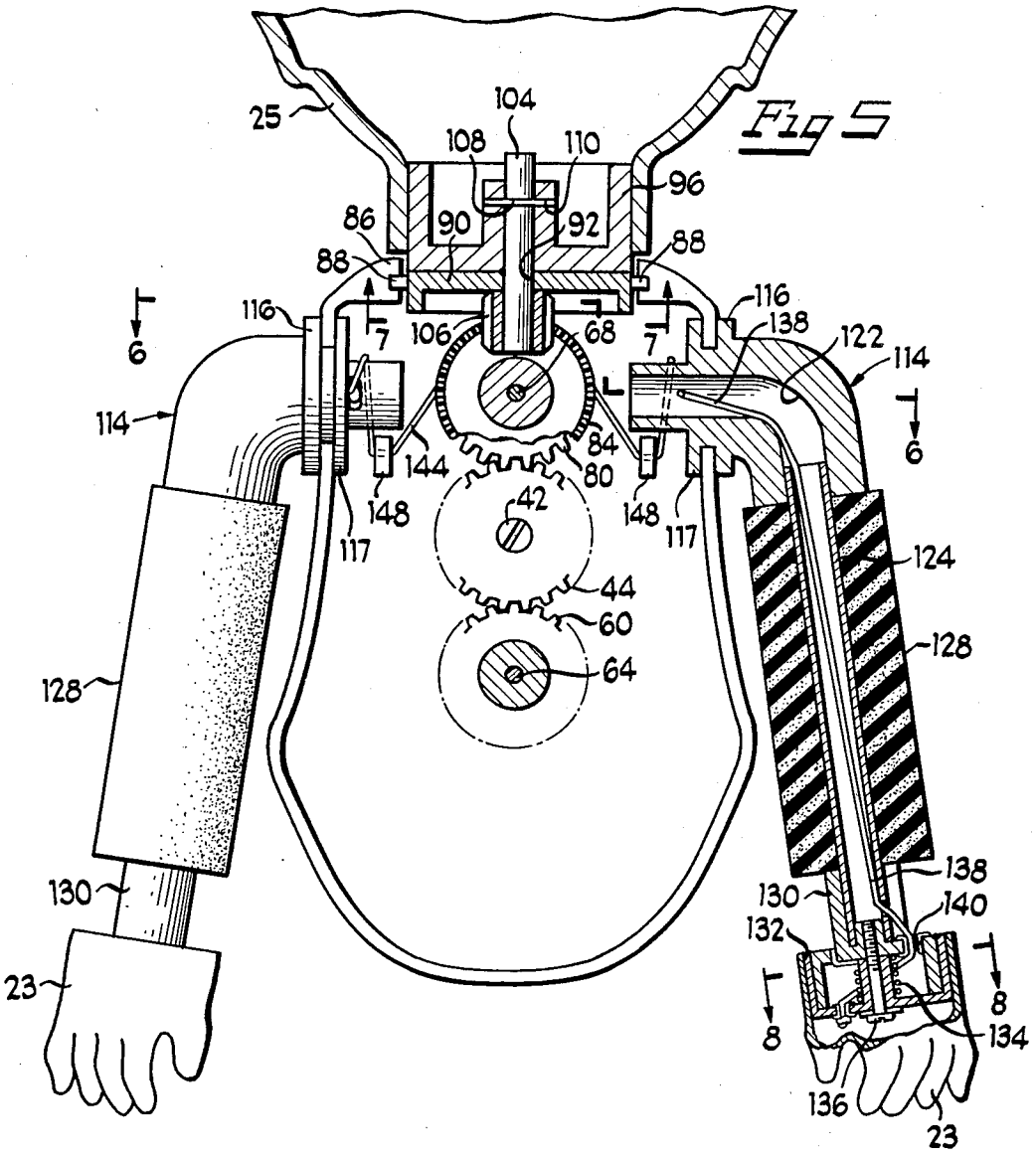
FIG. 5 is a sectional view taken generally along line 5—5 of FIG. 4.

As knob 30 is turned in the direction of the arrow in FIG. 9, that is, away from the left arm, line 144 is wrapped around sheave 82 and tightened causing slit tube 124 and foam piece 128 to bend in the area of the elbow as illustrated in FIGS. 2 and 10. Slits 126 along the side of the tube being compressed direct and facilitate the "elbow" bending of tube 124. At the same time that the tightening of the cable is bending the arm, it is also rotating shoulder piece 114 until outer flange 116 abuts stop 120. Simultaneously, cable 138 is causing cuff 132 with hand 23 to rotate toward the torso and head of the doll and tighten torsion spring 134. Also simultaneously, head 25 is being turned toward the left side by virtue of crown gear 84 turning engaging pinion 106 and rotating collar 96 so that it appears that the doll is raising its hand to its mouth. When the cable is loosened by turning the control knob the other way, the weight and resiliency of the arm will return it to the position shown in FIGS. 1 and 9 while torsion spring 134 will turn the hand back.

While a particular embodiment of the present invention has been shown and described, change and modifications will occur to those skilled in the art. It is intended in the following claims to cover all such changes and modifications as fall within the true spirit and scope of the present invention.

What is claimed as new and desired to be secured by Letters Patent is:

1. A doll comprising in combination:

a torso;

an arm carried by the torso;

the arm having a shoulder at one end adjacent to the torso and a hand at the other end;

the arm being mounted for rotational movement relative to the torso at the shoulder, shoulder rotation means adjacent to the shoulder to cause rotation of the arm at the shoulder, said arm is bendable intermediate the shoulder and the hand, a hollow resilient flexible tube intermediate the shoulder and the hand;

a cable passing through the tube;

one end of the cable being connected to the hand; and the other end of the cable passing through the shoulder in the torso and being connected to control means carried by the torso that movement of the control means in a predetermined direction tightens the cable and bends the arm upwardly from an at rest position down alongside of the torso and also causes the shoulder rotation means to rotate the arm relative to the torso at the shoulder.

2. The doll of claim 1 in which the control means comprises:

a rotatable knob on the outside of the torso;

a drive gear within the torso that is rotated by rotation of the knob;

a sheave within the torso rotatably driven by rotation of the knob; and the other end of the cable being connected to the sheave.

3. The doll of claim 1 including stop means on the torso for limiting rotational movement of the arm.

4. The doll of claim 1 in which:

the shoulder has a conduit with an axis;

the tube is in communication with the conduit;

a portion of the shoulder and the conduit are within the torso;

a bore, the axis of which is generally transverse to the conduit axis, extends from the portion of the conduit that is within the torso through the portion of the shoulder that is within the torso; and the cable passes into the torso through the conduit and the bore.

5. The doll of claim 4 in which the shoulder rotation means including:

a stationary eyelet is secured to the torso within the torso; and the cable passes from the bore through the eyelet and is then connected to the control means such that tightening the cable through the eyelet causes rotation of the conduit and the arm at the shoulder.

6. The doll of claim 1 in which:

the hand is rotatable relative to the tube; and tightening of the cable effects rotation of the hand in one direction.

7. The doll of claim 6 including means biasing rotation of the hand relative to the tube in a direction opposite the one direction.

8. The doll of claim 1 in which the tube has a plurality of slits along the side of the tube that is compressed when the arm is bent upwardly.

9. The doll of claim 1 in which:

the torso has a top and a bottom with an axis extending from top to bottom;

a head is carried by the torso for side to side rotational movement about the axis; and the control means also effects rotation of the head.

10. The doll of claim 9 including stop means to limit the extent of side to side rotational movement of the head.

11. The doll of claim 1 in which:

a sound drum having an internal weighted piston carrying a reed assembly is journaled within the torso; and the control means also manipulates the sound drum.

12. The doll of claim 9 in which:

the head is mounted on a collar having a central core through which an axial bore extends;

the collar is seated on a disk having trunions and a bore;

the bore in the disk and the bore in the collar are substantially coaxial and the axes of the trunions are generally transverse to the axis of the bores;

included in the torso are support ledges that receive the trunions;

a shaft extends through the bore in the disk and the bore in the collar and the shaft is keyed to the collar; and the shaft is in driving engagement with the control means.

13. The doll of claim 12 in which:

the disk includes an arcuate slot; and the collar has a depending stud that is received in the arcuate slot to limit the extent of side to side rotational movement of the head.

* * * * *